US005268561A

United States Patent [19]

Kimura et al.

[11] Patent Number: 5,268,561

[45] Date of Patent: Dec. 7, 1993

[54] TICKET ISSUING APPARATUS

[75] Inventors: Haruo Kimura; Hiroaki Ise; Hiroshi Ebata, all of Tokyo, Japan

[73] Assignee: Oki Electric Industry Co. Ltd., Tokyo, Japan

[21] Appl. No.: 748,069

[22] Filed: Aug. 21, 1991

[30] Foreign Application Priority Data

| | | | |
|---|---|---|---|
| Aug. 28, 1990 | [JP] | Japan | 2-224401 |
| Oct. 24, 1990 | [JP] | Japan | 2-284351 |
| Jan. 30, 1991 | [JP] | Japan | 3-029603 |

[51] Int. Cl.[5] ..... G07B 1/00; G07B 11/11

[52] U.S. Cl. ..... 235/384; 235/449

[58] Field of Search ..... 235/384, 449

[56] References Cited

U.S. PATENT DOCUMENTS

| | | | |
|---|---|---|---|
| 4,288,688 | 9/1981 | Kiyama et al. | 235/384 |
| 4,493,103 | 1/1985 | Yamashita et al. | 235/384 |
| 4,704,518 | 11/1987 | Brunn et al. | 235/480 |
| 4,965,438 | 10/1990 | Murofushi | 235/384 |
| 4,992,647 | 2/1991 | Konishi et al. | 235/384 |

FOREIGN PATENT DOCUMENTS

| | | | |
|---|---|---|---|
| 0181678 | 5/1986 | European Pat. Off. . | |
| 0269121 | 6/1988 | European Pat. Off. . | |
| 139268 | 8/1983 | Japan | 235/384 |
| 88/08962 | 11/1988 | PCT Int'l Appl. . | |
| 1508988 | 4/1978 | United Kingdom . | |

*Primary Examiner*—John Shepperd

*Attorney, Agent, or Firm*—Spencer, Frank & Schneider

[57] ABSTRACT

A ticket issuing apparatus has a slip storing section for storing slips which allow data to be magnetically written therein and printed out thereon, a magnetic data writing section for writing magnetic data in a slip fed from the slip storing section, a magnetic data reading section for reading the magnetic data out of the slip to see if the magnetic data is correct data, a printing section for printing data on the slip, a discharging section for discharging the slip after the magnetic writing and printing operations to the outside of the apparatus, and a transport path section for transporting the slip from the slip storing section to various other sections mentioned above. Part of the transport section is implemented as a circular transport path section. The magnetic data writing section and magnetic data reading section are arranged on the circular transport path section. The printing section is located in the vicinity of the circular transport path section.

20 Claims, 16 Drawing Sheets

TICKET ISSUING APPARATUS

BACKGROUND OF THE INVENTION

1. Field of the Invention

The present invention relates to an apparatus for issuing tickets and, more particularly to a ticket issuing apparatus for issuing the boarding tickets for vehicles such as airplanes and ships, or for invalidating such tickets, as needed.

2. Description of the Prior Art

Typical of ticket issuing apparatuses is one which deals with the boarding tickets for airplanes, ships, or similar vehicles. This kind of ticket issuing apparatus enters the departure time, arrival time, reserved seat number and other necessary items one a slip which is accommodated in the apparatus. The slip on which such items have been entered is emitted from the apparatus as a boarding ticket. To produce a boarding ticket, the slip is sequentially routed through a transport path provided in the apparatus.

A keyboard or similar input unit is associated with the ticket issuing apparatus and manipulated by an operator to enter the above-mentioned necessary items on the slip. The items entered on the input unit are not directly written on the slip. Specifically, the items entered on the input unit are first magnetically recorded on the slip as magnetic data by a magnetic write head or similar magnetic writing means which is disposed in the apparatus. Subsequently, the magnetic data are magnetically read out of the slip by a magnetic read head or similar magnetic reading means also disposed in the apparatus. The magnetic data read out of the slip are printed out on the slip in a predetermined format by printing means. These means constituting the apparatus are located on a predetermind transport path. It is a common practice to sequentially arrange the magnetic writing means, magnetic reading means and printing means in this order along a transport path which extends from the lower portion to the upper portion of the apparatus. A slip which is to be used to make a boarding ticket is fed from a slip storing section located in the apparatus to the upwardly extending transport path by suitable transporting means. The slip is sequentially routed through the magnetic writing means, magnetic reading means and printing means in this order and is then emitted from the apparatus through a slot located in the upper portion of the apparatus. Part of the transport path, between the magnetic writing means and the printing means, extends linearly in the up-and-down direction for mechanical reasons.

The problem with the conventional ticket issuing apparatus described above is that the portion of the transport path extending between the magnetic writing means and the printing means in the up-and-down direction increases the overall height of the apparatus. Such an apparatus is not very stable and requires a substantial space for installation when placed on a counter or similar support at an airport or similar facility. Since the printing means is positioned in close proximity to the top of the apparatus, the previously mentioned slot or outlet has also to be positioned at a high level. Handling tickets which come out of the apparatus at such a level is troublesome.

The conventional ticket issuing apparatus has only one slip storing section, which is loaded with a stack of slips. Hence, the apparatus cannot deal with an extra or further kind of boarding tickets, i.e., boarding tickets of another airline, unless the slips accommodated in the slip storing section are replaced by the extra kind of slips by the operator. If the extra kind of boarding tickets are not dealt with often the apparatus may be provided with a structure which makes it difficult to replace the slips existing in the slip storing section. Nevertheless, the operator has to handle the extra kind of boarding tickets one by one due to the inherent mechanical arrangement of the apparatus. In addition, a window assigned to the extra kind of boarding tickets, like the slot stated earlier, would necessarily be positioned in the upper portion of the apparatus.

Furthermore, when the slip storing section runs out of slips, it has to be refilled by interrupting the operation of the apparatus i.e., forcing a customer to wait. On the other hand, preparing a plurality of ticket issuing apparatuses to cope with such a situation would be expensive and require additional space for installation.

Generally, a boarding ticket issuing apparatus needs not only the issuing capability stated above but also a capability of invalidating or discarding a boarding ticket previously issued to a customer. It has been customary to provide such an apparatus with a single outlet for both of an invalidated boarding tickets and valid new boarding tickets. It is likely, therefore, that the operator might inadvertently hand an invalidated ticket to the customer in place of a valid ticket. While an exclusive outlet for invalidated tickets may be provided independently of the outlet for valid tickets, such an implementation would increase the number of transport paths and thereby complicate the mechanical arrangement, resulting in an increase in cost.

SUMMARY OF THE INVENTION

It is therefore an object of the present invention to provide a ticket issuing apparatus which is small in size and remains stable on a counter or similar support.

It is another object of the present invention to provide a ticket issuing apparatus which is easy to operate.

It is another object of the present invention to provide a ticket issuing apparatus capable of dealing with a plurality of different kinds of tickets, as needed.

It is another object of the present invention to provide a ticket issuing apparatus capable of issuing a great number of tickets continuously without interruption.

It is another object of the present invention to provide a ticket issuing apparatus which can reliably invalidate a ticket previously issued to a customer.

A ticket issuing apparatus in accordance with the present invention has a slip storing section for storing slips which allow data to be magnetically written therein and printed out thereon, a magnetic data writing section for writing magnetic data in a slip fed from the slip storing section, a magnetic data reading section for reading the magnetic data out of the slip to see if the magnetic data is correct, a printing section for printing data on the slip, a discharging section for discharging the slip after the magnetic writing and printing operations to the outside of the apparatus, and transport path sections for transporting the slip from the slip storing section to the various other sections mentioned-above. The transport path sections include a circular transport path section or a transport drum path section. The magnetic data writing section and magnetic data reading section are arranged along the circular transport path section. The printing section is located in the vicinity of the circular transport path section.

BRIEF DESCRIPTION OF THE DRAWINGS

The objects and features of the present invention will become more apparent from a consideration of the following detailed description taken in conjunction with the accompanying drawings in which.

DESCRIPTION OF THE PREFERRED EMBODIMENT

Figure 1:
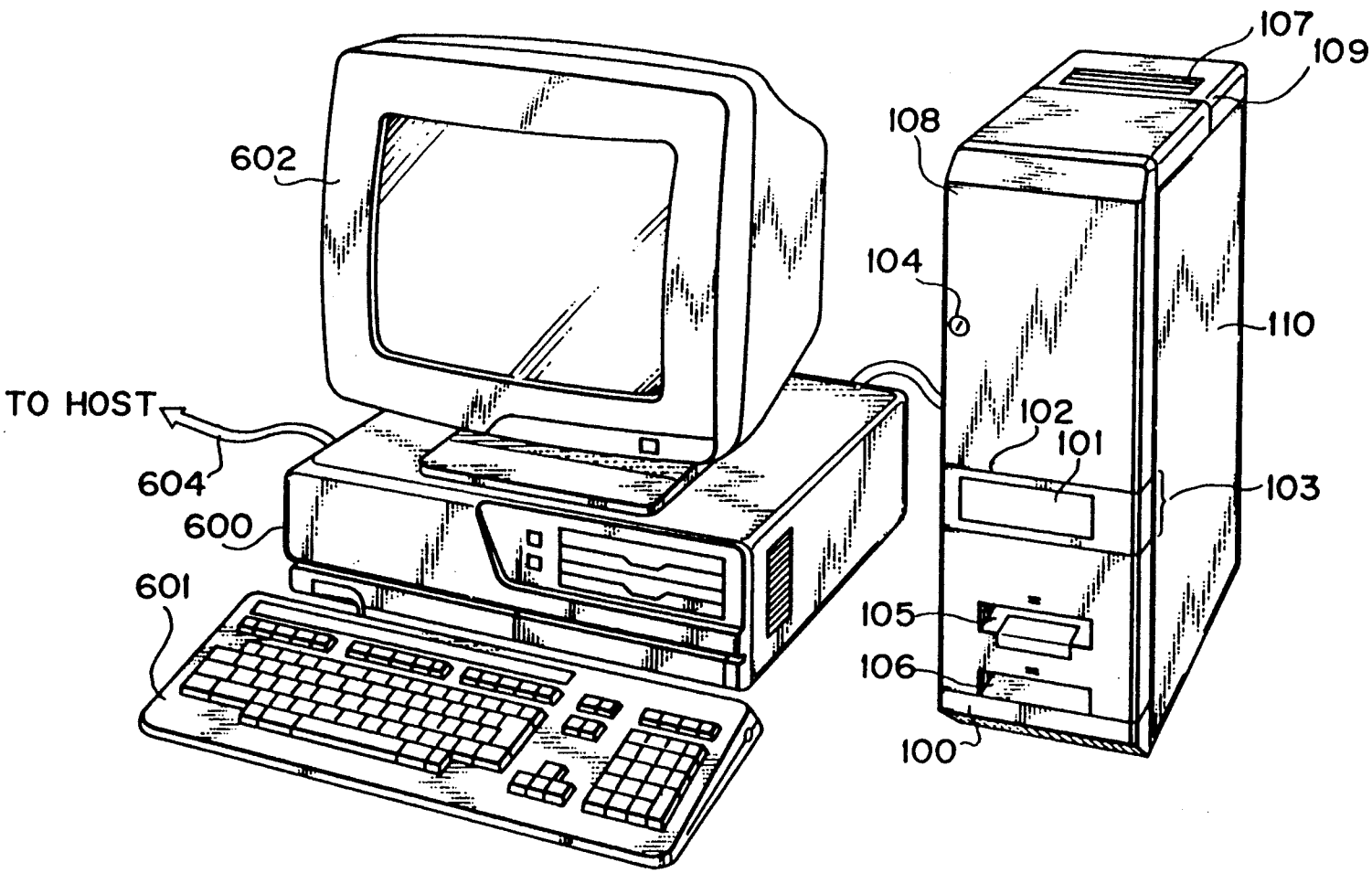
FIG. 1 is a perspective view showing a ticket issuing apparatus embodying the present invention.

Referring to FIG. 1 of the drawings, the general arrangement of a ticket issuing apparatus embodying the present invention is shown and implemented as a boarding ticket issuing apparatus by way of example. As shown, the apparatus is generally made up of a body 100, a main control unit 600, an input unit in the form of a keyboard 601, and a display unit in the form of a CRT 602. The keyboard 601 and CRT 602 are connected to the main control unit 600 which is in turn connected to a host computer, not shown, by a line 604.

The apparatus body 100 has an operation panel 101 on the front end thereof. The operation panel 101 has lamps or indicators 102 and a display section 103 arranged thereon. The lamps 102 include a power lamp indicative of the ON/OFF state of the power source of the apparatus and various kinds of alarm lamps. Implemented as a liquid crystal display, for example, the display section 103 displays messages for alerting the operator to various kinds of occurrences in the apparatus body 100 which need the operator's immediate attention, e.g., a slip jam or a shortage of slips. Slots 105 and 106 are provided on the front end of the apparatus body 100 to serve as a ticket outlet and a ticket inlet, respectively. Specifically, a slip on which necessary items have been printed out, i.e., a boarding ticket, is emitted from the apparatus body 100 via the slot 105. On the other hand, a boarding ticket to be invalidated or discarded after having been issued to a customer is inserted into the apparatus body 100 via the slot 106. The upper half of the front end of the body 100 is closed by a front door 108 having a key hole 104 therein. The operator can open or close the front door 108 by inserting a key, not shown, into the key hole 104. A door 109 is provided on the top of the apparatus body 100 and openable for various purposes such supplying a so-called journal paper. A slot 107 is formed at the center of the top door 109. A journal paper printed with data by a journal printer 160, which will be described later, is emitted from the apparatus body 100 via the slot 107. Further, a side door 110 is provided on one side of the apparauts body 100 and accessible to replace a transfer paper or pad existing in a printing section 610, which will be described later or to remove a slip or ticket medium that has jammed in the apparatus body 100.

Figure 2:
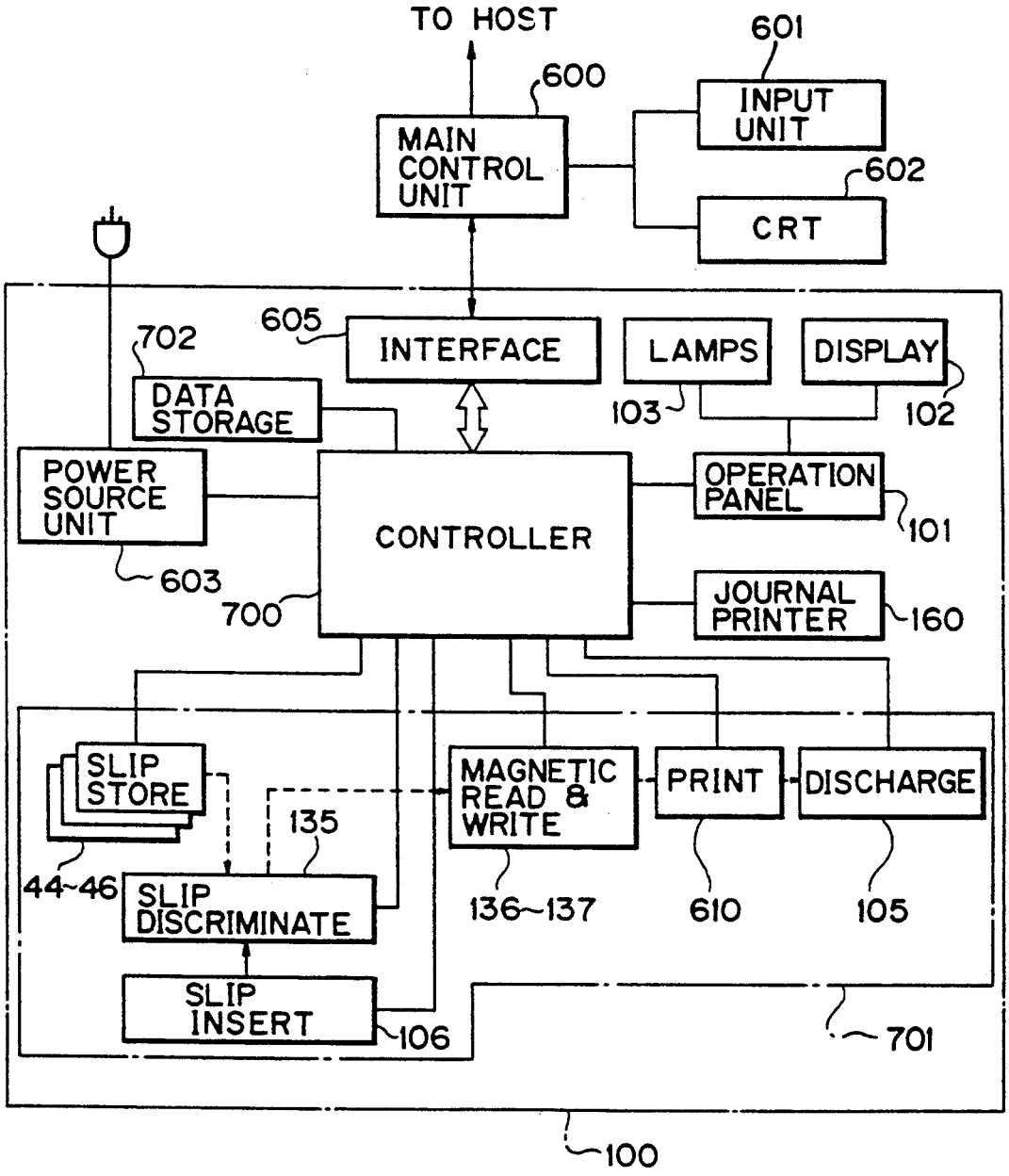
FIG. 2 is a block diagram schematically showing the embodiment.

FIG. 2 shows the electrical arrangement incorporated in the apparatus body 100 as a schematic block diagram. In the figure, the route which a slip or ticket medium follows is indicated by phantom lines with an arrow. As shown, the operation panel 101, the journal printer 160, a power source unit 603 and a mechanical section 701 are connected to a controller 700. The power source unit 603 feeds power to various electrically operated components incorporated in the apparatus body 100. The controller 700 is connected to the main control unit 600 via an interface 605. Also connected to the controller 700 is a data storage unit 702 which stores data for identifying or discriminating various kinds of slips (hereinafter referred to as discrimination data). The discrimination data is entered on the input unit 601 by the operator.

Figure 3:
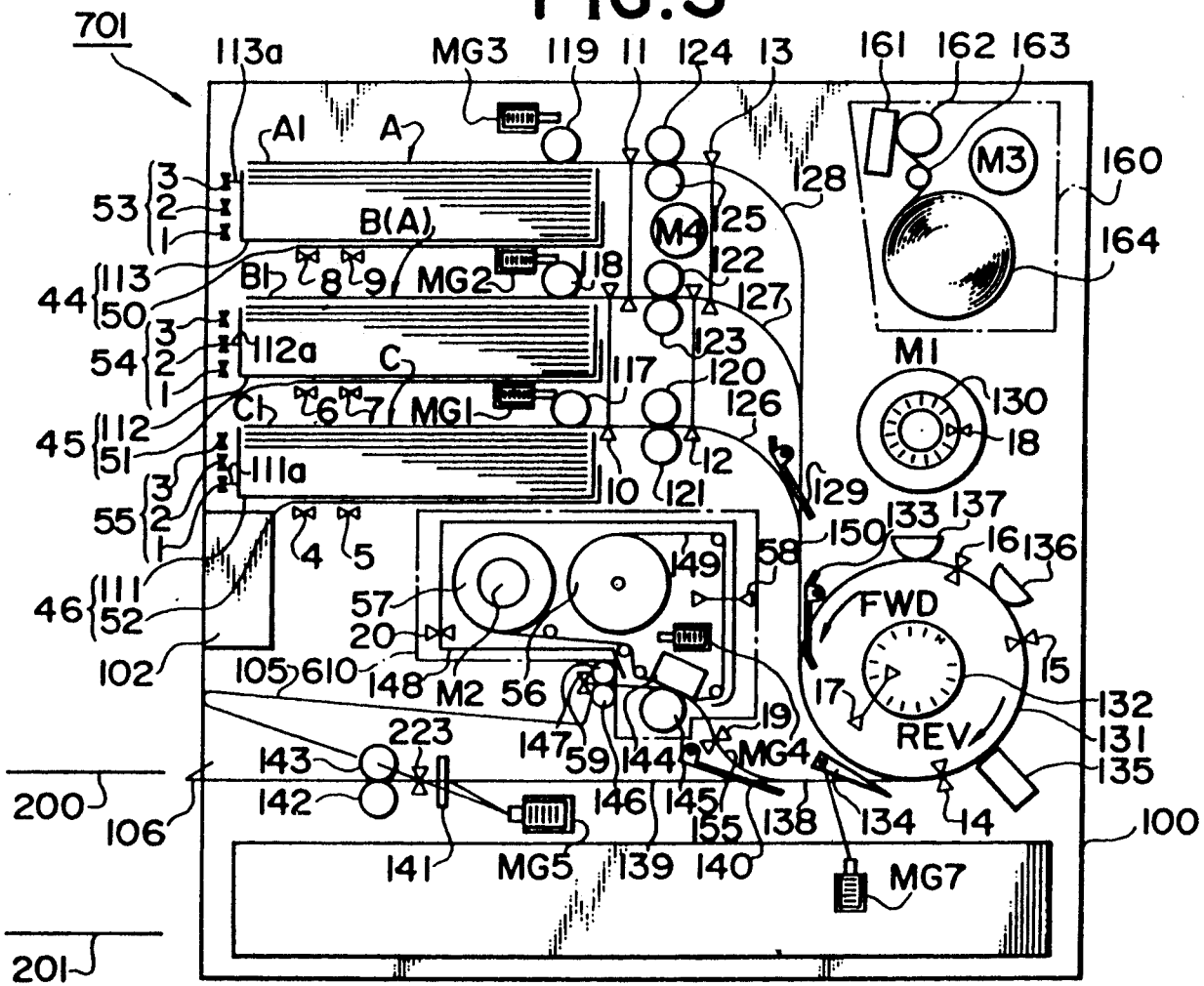
FIG. 3 is a view showing the general construction of a body included in the embodiment.

Referring to FIG. 3, the mechanical section 701, which serves various mechanical functions in the apparatus body 100, will now be described. As shown, a plurality (three in the embodiment) of slip storing sections 44, 45 and 46 are arranged one above another in an upper portion of the apparatus body 100. The uppermost slip storing section 44 has a cassette mount 50, and a cassette 113 removably mounted on the cassette mount 50. Likewise, the intermediate slip storing section 45 and the lowermost slip storing section 46 have respectively a cassette mount 51 and a cassette 112 and a cassette mount 52 and a cassette 111. The cassette 113 is provided with a lug **113*a* (see FIG. 4A) in the upper portion thereof and loaded with a stack of slips A belonging to a particular airline, e.g., airline A. The cassette 112 is provided with a lug 112*a* (see FIG. 4B) in the intermediate portion thereof and is loaded with a stack of slips B belonging to another airline B. Further, the cassette 111 is provided with a lug 111*a* (see FIG. 4C) in the lower portion thereof and is loaded with a stack of slips C belonging to still another airline C. It is to be noted that the cassette 111, 112 and 113 are replaceable with one another, e.g., the cassette 111 may be laid on the cassette mount 50 or 51**.

Sensor groups 53, 54 and 55 each comprising cassette sensors 1, 2 and 3 are respectively located at positions where the cassettes 111, 112 and 113 are to be mounted. In the illustrative embodiment each of the cassette sensors 1, 2 and 3 is implemented by a photocoupler. When any one of the cassettes 111–113 is mounted on any one of the cassette mounts 50–52, the lug **111*a*, 112*a* or 113*a* of the cassette interrupts the optical path of the cassette sensor 1, 2 or 3 of the associated sensor group 53, 54 or 55. The resultant output of the cassette sensor 1, 2 or 3 is sent to the controller 700, FIG. 2. For example, assuming that the cassette 113 is mounted on the cassette mount 50, then the lug 113*a* therefore interferes with the cassette sensor 3 of the sensor group 53 to inform the controller 700 of such a condition. This allows the controller 700 to see that the cassette 113 has been loaded on the cassette mount 50. If the cassette 113 is loaded on another cassette mount 51 or 52, the lug 113***a* interferes with the cassette sensor 3 of the sensor group 54 or 55 associated with the cassette mount 51 or 52. This is also true with the other cassettes 112 and 111. In this manner, the controller 700 sees which of the cassettes 111–113 is positioned on which of the cassette mounts 50–52. While the sensor groups 53–55 are located at the left-hand side of the cassettes 111–113 as viewed in FIG. 3, they may be located at any other suitable position so long as they can serve the assigned function.

Figure 5:
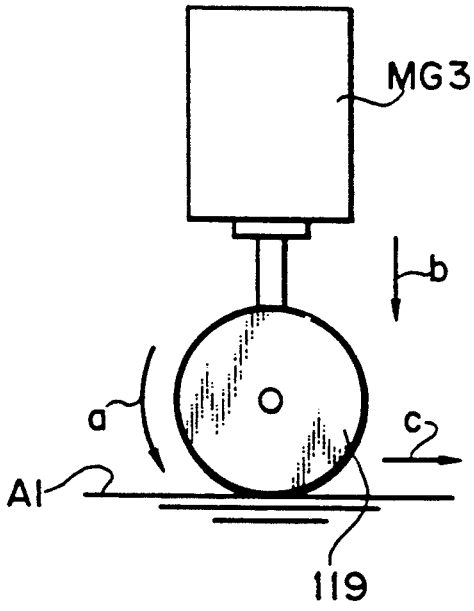
FIG. 5 is a view of a mechanism for actuating a pick-up roller.

Pick-up rollers 119, 118 and 117 are respectively disposed above the uppermost slips or ticket media A1, B1 and C1 stored in the cassettes 111, 112 and 113. Actuators implemented as solenoids MG3, MG2 and MG1 are associated with the pick-up rollers 119, 118 and 117, respectively. FIG. 5 demonstrates how the pick-up roller 119, for example, picks up the uppermost slip A1 from the uppermost slip storing section 44. As shown, the pick-up roller 119 starts rotating in a direction indicated by an arrow a, while the solenoid MG3 is energized to urge the pick-up roller 119 downward as indicated by an arrow b. As a result, the pick-up roller 119 is pressed against the slip A1 to pay it out in a direction indicated by an arrow c.

A feed roller 124 and a reverse roller 125 are provided in a pair in the vicinity of the pick-up roller 119. Likewise, a feed roller 122 and a reverse roller 123 and a feed roller 120 and a reverse roller 121 are provided in pairs in the vicinity of the pick-up rollers 118 and 117, respectively. These pairs of feed rollers and reverse rollers are driven by a common drive source M4 such that one roller of each pair rotates in a direction opposite to the other roller.

Pick-up sensors 10 and 11 are located in close proximity to the pick-up rollers 119–117 in order to determine whether or not any one of the slips A–C has been paid out from the associated cassette. Specifically, when the slip C is paid out from the cassette 111, the sensor 10 produces a detection output representative of such a condition. When the slip B is paid out from the cassette 112, both of the sensors 10 and 11 produce a detection output. Further, when the slip medium A is paid out from the cassette 113, the sensor 11 produces a detection output. Such output signals of the sensors 10 and 11 are sent to the controller 700, FIG. 2. Hence, the controller 700 determines which of the ticket media A–C each belonging to a particular airline has been picked up by referencing the outputs of the sensors 10 and 11.

Sensors 12 and 13 are located downstream of the feed rollers 124–120 with respect to the direction in which the slips A–C are paid out. When the slip C is fully paid out from the cassette 111, the sensor 12 produces a detection output. When the slip B is fully paid out from the cassette 112, both of the sensors 12 and 13 produce a detection output. Further, when the slip A is fully paid out from the cassette 113, the sensor 13 produces a detection output. These outputs of the sensors 12 and 13 are also transferred to the controller 700. In response, the controller 700 determines which of the slips A–C has been fully paid out. In the illustrative embodiment, each of the sensors 10–13 described above is constituted by a photocoupler.

It is to be noted that the cassettes 111–113 may each be constructed as a unit together with the associated peripheral mechanisms including the pick-up roller 119, 118 or 117, solenoid MG1, MG2 or MG3, and feed roller 124, 122 or 120. In the illustrative embodiment, one, two or three cassettes are usable, as desired by the user, for example. Moreover, an extra cassette or cassettes can be additionally incorporated in the mechanical section 701 even after the installation of the apparatus. Hence, an apparatus having a cost and structure adopted to a particular application can be readily implemented.

Figure 6A:
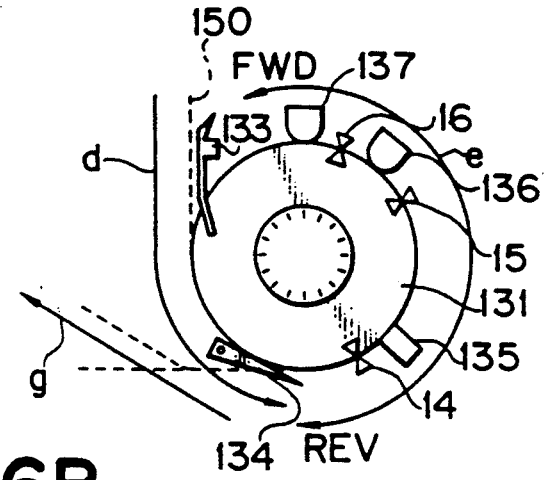
FIGS. 6A through 6C are views demonstrating the operation of a transport drum and members associated therewith.

Transport paths 126, 127 and 128 extend from the cassettes 111, 112 and 113 and merge into a common transport path 150 which terminates at a transport drum 131. The slips A–C from the cassettes 113–111 are routed through a respective one of the transport paths 128–126 and common transport path 150 to the transport drum 131. After it reaches the transport drum 131, a slip A, B, or C is caused to wrap therearound by suitable means such as a plurality of pressure rollers, not shown, which are held in pressing contact with the drum 131. The diameter of the transport drum 131 is selected to be smaller than the lengthwise dimension of the slips A–C. In the illustrative embodiment, the diameter of the transport drum 131 is substantially one-half of the length of the slips A–C. Sequentially arranged around the transport drum are a timing sensor 14 for use when a bar code which will be described is read, a slip discriminting unit 135 for discriminating the various kinds of slips A–C, a timing sensor 15 for magnetic writing, a magnetic write head 136, a timing sensor 16 for magnetic reading, and a magnetic read head 137. Implemented as a bar code reader, the slip discriminating unit 135 reads a bar code provided on a slip at a particular timing determined by the timing sensor 14. A slip coming in through the common transport path 150 in a direction indicated by an arrow d, in FIG. 6A is caused to wrap around the transport drum 131 and is thereby transported in a forward direction indicated by an arrow e and labeled FWD. The write head 136 magnetically writes data in the slip at a particular timing determined by the timing sensor 15. As the transport drum 131 further rotates, the read head 137 magnetically reads the data out of the slip at a particular timing determined by the timing sensor 16.

A rotation sensing disk 132 is mounted on a rotary shaft, not shown, on which the transport drum 131 is mounted. The disk 132 has a number of slits for monitoring and controlling the movement of the slip during the magnetic write-in and read-out of data. A sensor 17 senses the slits of the disk 132 and is constituted by a photocoupler. A blade 133 is located at the left-hand side and in an upper portion of the transport drum 131. When the slip being transported by the transport drum 131 in the forward direction FWD abuts against the blade 133, the blade 133 is rotated by the slip with the result that the slip is simply allowed to move forward. On the other hand, if the transport drum 131 is rotated in the other or reverse direction REV, the slip being transported by the drum 131 is guided by the blade 133 to the common transport path 150, as indicated by an arrow f in FIG. 6C.

Figure 7:
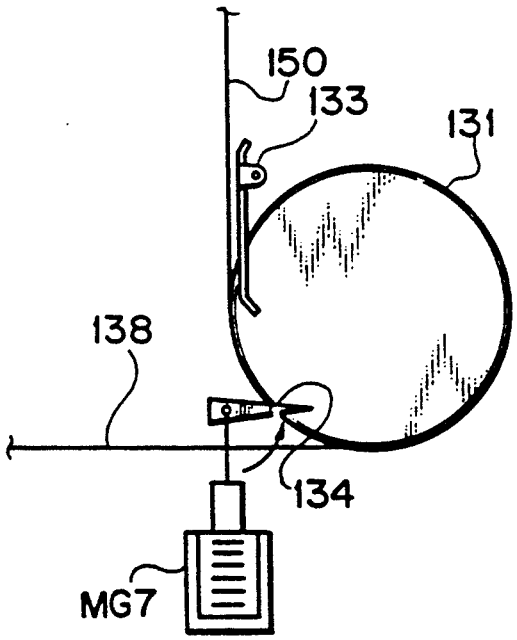
FIG. 7 is a view showing the operation of a blade included in the embodiment.

Another blade 134 is located at the left-hand side and in a lower portion of the transport drum 131. Assume that the read-out of a bar code, the write-in of magnetic data and other operations have been completed with the slip wrapped around the drum 131. Then, as shown in FIG. 7, the blade 134 is rotated counterclockwise by a solenoid MG7 to guide the slip toward a printing section 610 which will be described later. More specifically, the blade 134 guides such a slip to a transport path 138, as indicated by an arrow g in FIG. 6A.

The transport path 138 branches off to merge into two transport paths 155 and 139. A sensor 19 for sensing the slip or ticket medium is located on the transport path 155 slightly downstream of the branching point of the transport path 138 with respect to the direction of transport of the slip. The printing section 610 is disposed in a lower portion of the apparatus body 100 and on the transport path 155 downstream of the sensor 19. The printing section 610 neighbors the transport drum 131 in the horizontal direction. The printing section 610 has a print head 144, a platen roller 145 against which the head 144 is pressed, a transfer paper cassette 148, and a solenoid MG4 for pressing the head 144 against the platen roller 145. The transfer paper cassette 148 accommodates therein a feed bobbin 56 for feeding a transfer paper 149, and a take-up bobbin 57 for taking up the transfer paper 149. The take-up bobbin 57 is rotated by a motor M2. While the print head 144 is not in a printing operation, it is spaced apart from the platen roller 145. This prevents a load from acting on the slip while the latter is transported before or after printing, i.e., when data is not to be printed out on the slip. The printing section 610 has a sensor 20 for sensing the transfer paper cassette 148, and a sensor 58 responsive to a near-end mark and an end mark provided on the transfer paper 149. The near-end mark and the end mark indicate respectively that the transfer paper 149 will soon end and that it has ended.

The slip on which the print head 144 has printed out the necessary data is driven to between a drive roller 146 and a driven roller 147. Then, the drive roller 146 drives the slip toward the slot or ticket outlet 105. The operator pulls out the slip driven out via the slot 105 and then hands it to the customer or passenger as a boarding ticket. A sensor 59 is located in close proximity to the drive roller 146 to see if the slip has been completely discharged to the outside via the slot 105.

A blade 140 is located at the position where the transport path 138 branches off into the transport paths 155 and 139. Assume that a boarding ticket previously issued to a customer is inserted into the slot or ticket inlet 106 of the apparatus body 100 so as to be invalidated or discarded. Then, as the boarding ticket is transported along the transport path 139, it abuts against the blade 140 and rotates it counterclockwise. As a result, the blade 140 guides the boarding ticket toward the transport drum 131. Usually, the blade 140 is so positioned as to isolate the transport path 139 from the transport path 138, so that a slip from the path 138 may be steered toward the printing section 610.

A drive roller 142, a driven roller 143 which is driven by the drive roller 142, a sensor 223 responsive to an incoming slip, a stop 141 for preventing a slip from entering the body apparatus 100, and a solenoid MG5 are arranged on the transport path 139 which extends from the ticket inlet 106. On sensing a slip, or boarding ticket in this case, the sensor 223 sends a detection signal to the controller 700. In response, the controller 700 energizes the solenoid MG5 on the elapse of a predetermined period of time $t_3$. As a result, the solenoid MG5 opens the stop 141 to allow the incoming slip to advance and presses the driven roller 143 against drive roller 142. Then, the rollers 142 and 143 cooperate to drive the incoming slip to the transport path 139. The rotation of the drive roller 142 is controlled by the controller 700.

The rollers of the transport paths, platen roller 145 and transport drum 131 are driven by a main motor M1. A disk 130 is mounted on the output shaft of the main motor M1 and formed with timing slits. While the disk 130 is rotated together with the main motor M1, a sensor 18 senses the timing slits of the disk 130 while sending the output thereof to the controller 700. In response, the controller 700 controls the rotation speed of the main motor M1 and, therefore, the accuracy and velocity of transport of a slip. Regarding the drum 131, the rotation may be controlled by a rotary encoder, if desired.

A blade 129 is disposed above the common transport path 150 into which the transport paths 126–127 merge, as stated earlier. When the slip A or B being transported along the path 128 or 127 abuts against the blade 129, it causes the blade 129 to rotate clockwise. In this condition, the blade 129 guides the slip A or B to the common path 150. On the other hand, assume that a slip in the form of a boarding ticket is transported upward by way of the common path 150 to be invalidated, as will be described in detail later. Then, the blade 129 is not rotated by such a slip and guides it to the transport path 126.

The journal printer 160 is disposed in an upper portion of the body 100. The journal printer 160 is made up of a print head 161, a platen 162, a paper guide 163, a motor M3 for driving the platen 162, and a journal paper 164 in the form of a roll. The part of the journal paper 164 on which data has been printed out is driven out of the apparatus body 100 via the slot 107, FIG. 1.

Near-end sensors 8, 6 and 4 are respectively disposed below the slip storing sections 44, 45 and 46, and each is responsive to a condition in which the number of slips A, B or C remaining in the associated storing section is low. End sensors 9, 7 and 5 are respectively located in close proximity to the near-end sensors 8, 6 and 4, and each senses a condition in which all the slips have been fed out of the associated storing section. In response to the outputs of the near-end sensors 4–8 and end sensors 9–5, the controller 700 shows a corresponding alarm condition on the display 103, FIG. 1.

Figures 4A, 4B, 4C:
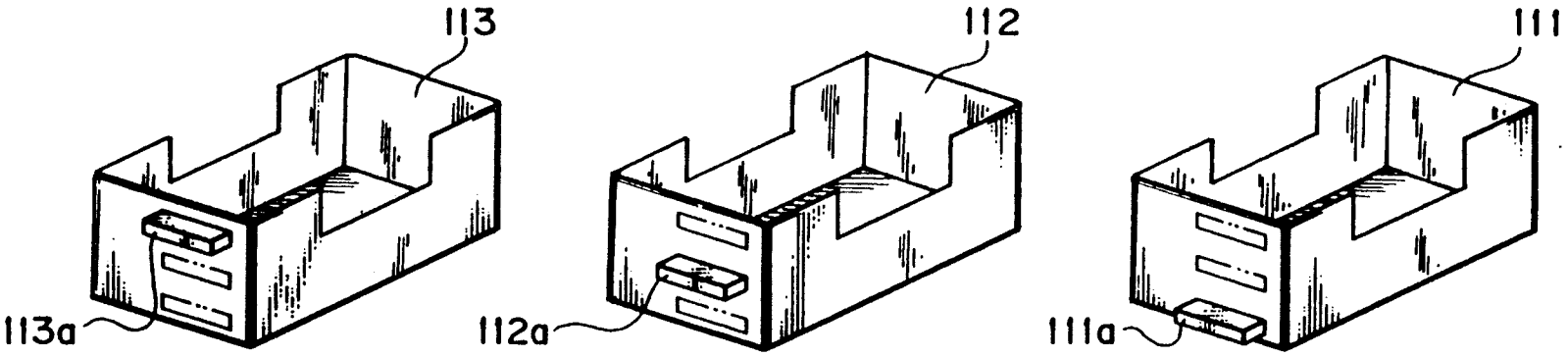
FIGS. 4A through 4C are fragmentary perspective views each showing a particular cassette to be loaded with slips.
Figure 8:
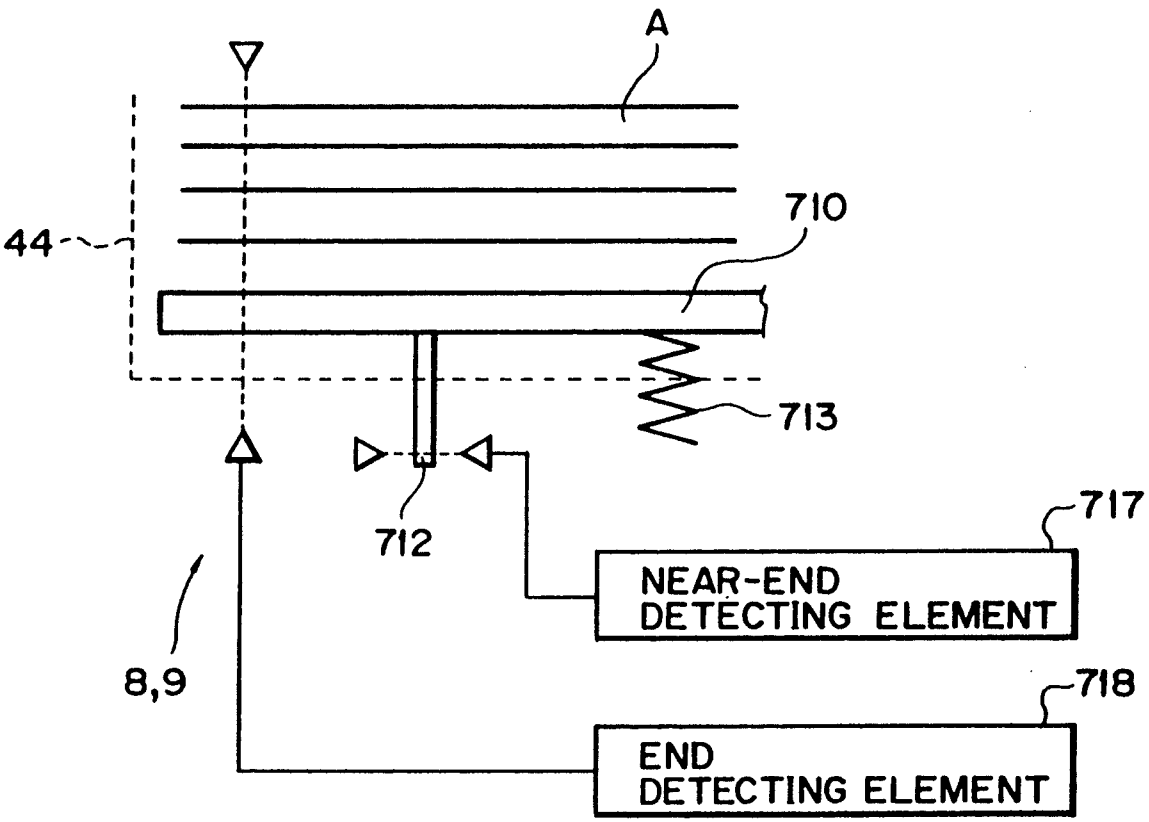
FIG. 8 shows the construction of a near-end sensor and an end sensor.

FIG. 8 schematically shows the construction of a near-end sensor and an end sensor, taking the near-end sensor 8 and end sensor 9 as an example. As shown, the slip storing section 44 has a bottom plate 710 from which a lug 712 extends out. The lug 712, like the lug shown in any one of FIGS. 4A through 4C, is sensed by a near-end detecting element 717. Specifically, the near-end detecting element 717 is implemented by a photocoupler as in the sensor groups 53–55 shown in FIG. 3. The bottom plate 710 is loaded with the slips A and constantly biased upward by a spring 713. Hence, as the number of slips A remaining on the bottom plate 710 decreases, the bottom plate 710 and, therefore, the lug 712 is raised by the action of the spring 713. The near-end detecting element 717 responds to the rise of the lug 712 above a predetermined level. On the other hand, an end detecting element 718 has sensing elements located at opposite sides of the stack of slips A and bottom plate 710. When all the slips A are fed out, the end detecting element 718 senses such a condition through an aperture formed through the bottom plate 710.

The operation of the illustrative embodiment described above will be described with reference to FIGS. 9A to 9C. The data storage unit 702, FIG. 2, stores slip discrimination data for discriminating the various kinds of slips or ticket media. Such data is entered on the input unit 601 and, in the embodiment, shows that the slips A, B and C are stacked on the cassettes 113, 112 and 111, respectively. The controller 700 edits and generates slip discrimination data on the basis of such data entered on the input unit 601, and then writes the data edited and generated to the location of a prescribed address in the data storage unit 702.

Figure 9A:
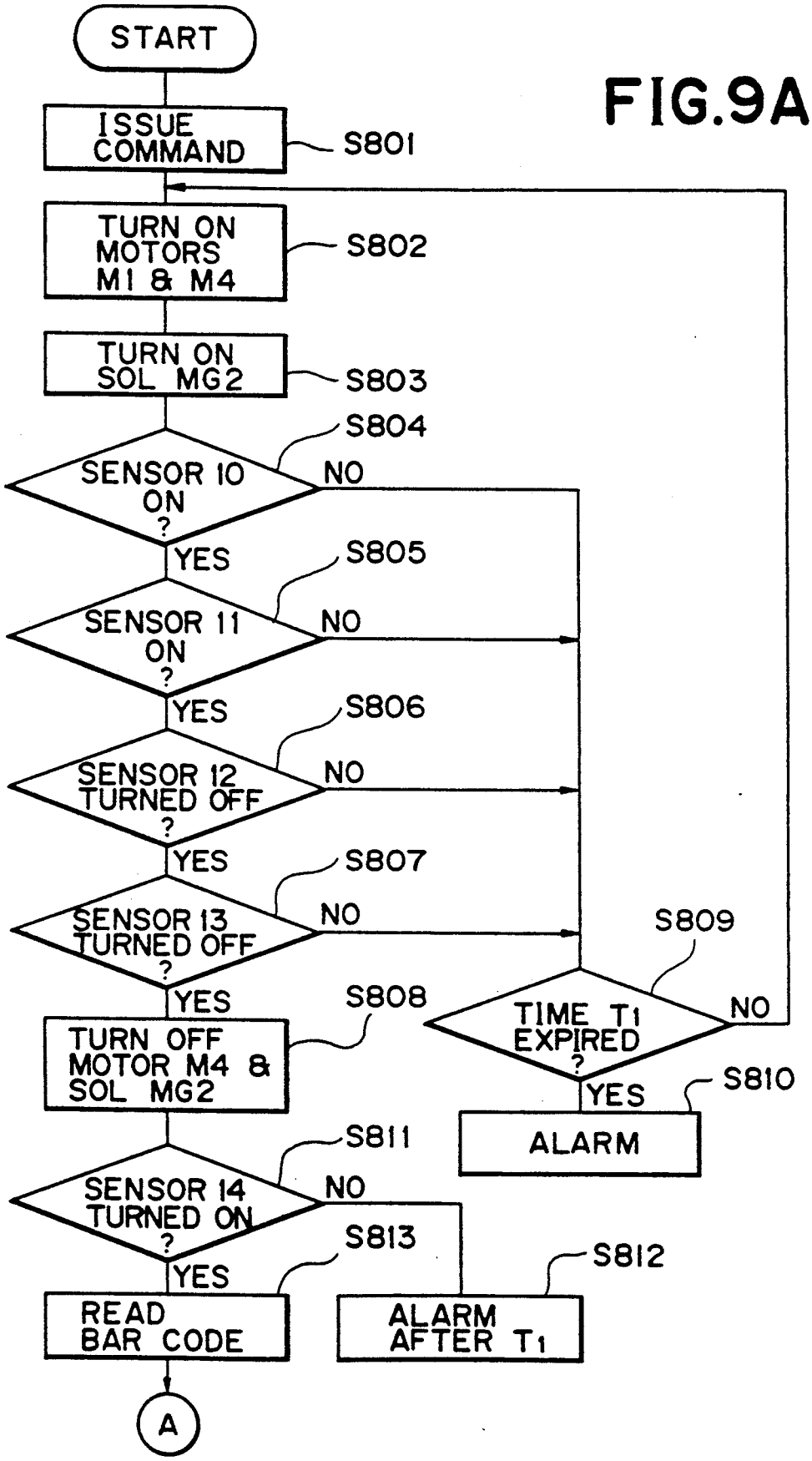
FIG. 9A through 9C are flowcharts showing the operation of the embodiment while issuing a ticket.
Figure 9B:
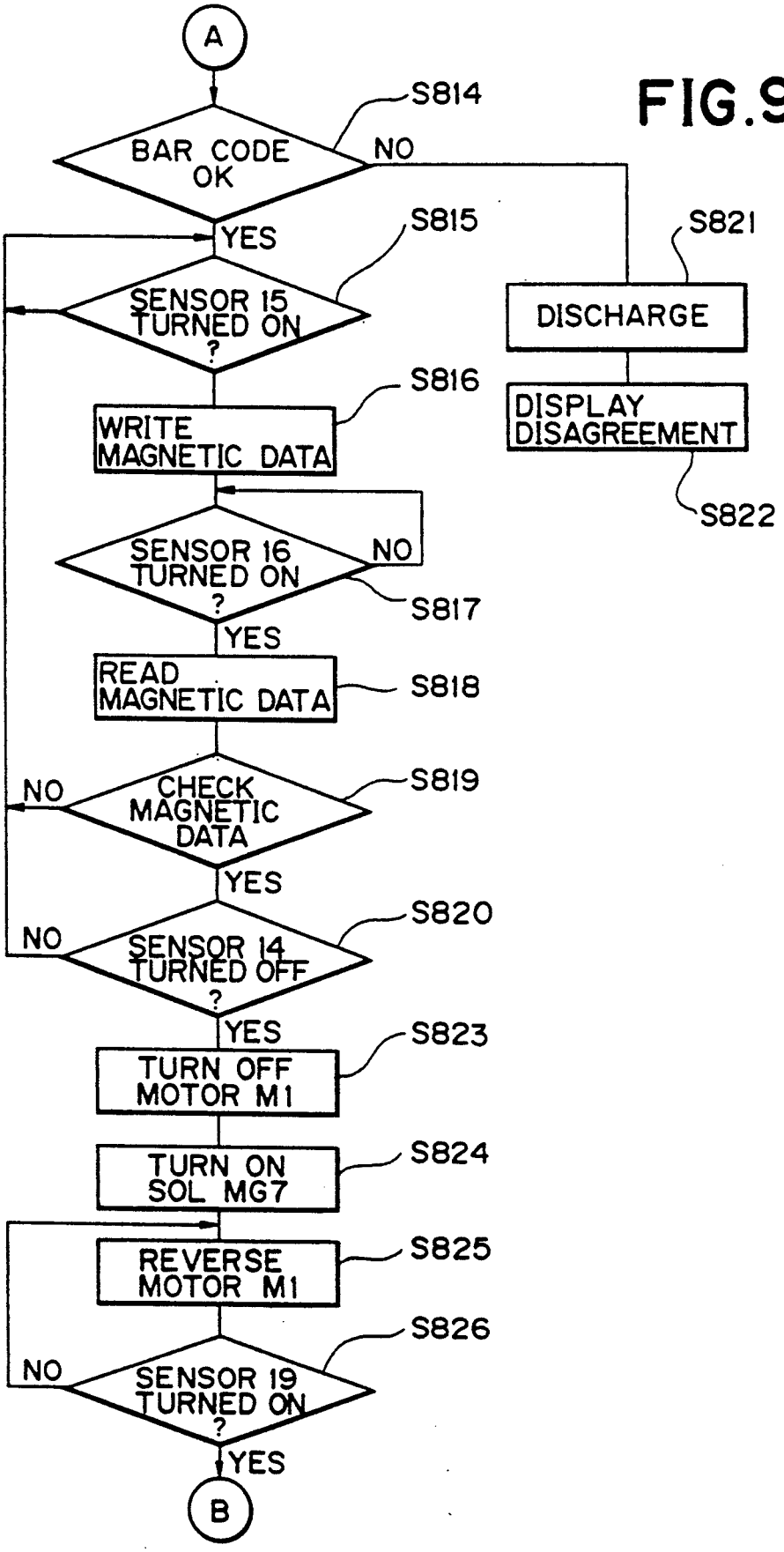
Figure 9C:
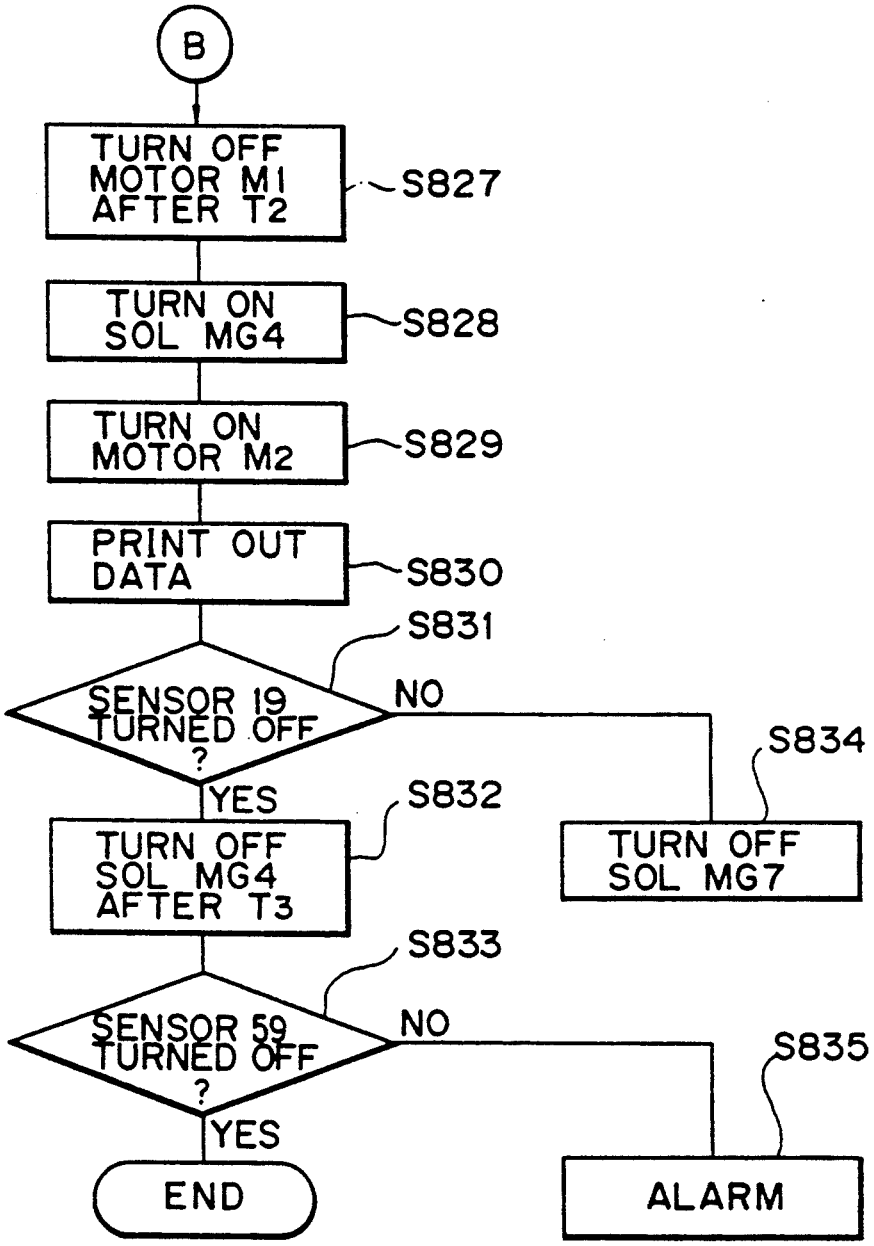

In FIG. 9A, assume that the operator has manipulated the input unit 601 to enter a command for issuing, for example, a boarding ticket of the airline B (step S801). In response to the command, the controller 700 energizes the main motors M1 and M4 (S802) and then scans the data storage unit 702 to determine which cassette stores the slips B of the airline B. In this case, the controller 700 determines that the cassette 112 is loaded with such slips B. Subsequently, the controller 700 sees that the cassette 112 of interest exists in the slip storing section 45 in response to the output of the cassette sensor 2 of the sensor group 54 which is responsive to the lug 112*a*.

Thereupon, the controller 700 energizes the solenoid MG2 to cause the pick-up roller 118 to abut against the uppermost one of the slips B1 of the cassette 112 (S803). Then, the controller 700 starts driving the pick-up roller 118 to pay out the slip B1 from the cassette 112 toward the coactive feed roller 122 and reverse roller 123. Subsequently, the feed roller 122 and reverse roller 123 are rotated to nip the slip B1 and drive it further to the transport path 127. The sensors 10 and 11 sense the slip B1 and send outputs to the controller 700 (S804 and S805). When the slip B1 is fully fed out to the transport path 127, the sensors 12 and 13 turn off (S806 and S807) and send outputs to the controller 700. Then, the controller 700 deenergizes the solenoid MG2 and motor M4 by determining that the slip B1 has been fully fed out from the cassette 112 (S808). In this condition, the slip B1 is allowed to advance toward the transport drum 131, as indicated by the arrow d in FIG. 6A.

Assume that the result of decision in any one of the steps S804–S807 is negative (N), meaning that an expected sensor output has not appeared. Then, on the elapse of a predetermined period of time $t_1$ (S809), the controller 700 turns on an alarm lamp included in the lamps or indicators 102 to inform the operator of the fact that the slip B1 has not been paid out from the cassette 112 (S810).

After deenergizing the motor M4 (S808), the controller 700 checks the timing sensor 14 associated with the transport drum 131 to see if it has outputted a detection signal (S811). If the predetermined period of time $t_1$ expires before the controller 700 receives such an output of the timing sensor 14 (S812), the controller 700 turns on the alarm lamp included in the lamps 102 (S812). On receiving a detection signal from the timing sensor 14 (Y, S811), the controller 700 determines that the slip B1 has been accurately transported to a predetermined position via the transport paths 127 and 150 by the transport drum 131. Then, the controller 700 enables the slip discriminating unit or bar code reader 135 to read a bar code provided on the slip B1 (S813). When the controller 700 has identified the slip B1 via the slip discriminating unit 135 (S814), it further rotates the transport drum 131 in the direction FWD to move the slip B1 toward the timing sensor 15. As the timing sensor 15 sends a detection signal indicative of the arrival of the slip B1 thereat to the controller 700 (S815), the controller 700 causes the magnetic write head 136 to write magnetic data in the slip (S816). The magnetic data to be written in the slip B1 is obtained from a host computer installed in the airline B and includes the airplane number, reserved seat number, and departure time.

As the transport drum 131 is further rotated, the timing sensor 16 sends a detection signal indicative of the arrival of the slip B1 thereat to the controller (S817). In response, the controller 700 enables the magnetic read head 137 to read the magnetic data written in the slip B1 by the write head 136 (S818). Then, the controller 700 determines whether or not the data read by the read head 137 is identical with the data written by the write head 136 (S819). If the read data is not identical with the written data (N, S819), the controller 700 rotates the transport drum 131 in the reverse direction REV and returns to the step S815 to repeat the successive steps S816–S819, i.e., writes magnetic data and reads it again. If the bar code read in the step S814 is not representative of the slip B1, the controller 700 rejects and discharges the slip (S821). At the same time, the controller 700 displays an alarm on the display 102 to show the operator that the slip that reached the transport drum 131 is not the desired slip B1 (S822).

If the data read by the read head 137 is identical with the data written by the write head 136 as determined in the step S819, the controller 700 determines whether or not the detection signal from the timing sensor 14 has disappeared (S820). If the detection signal has disappeared (Y, S820), the controller 700 determines that the slip B1 has reached a predetermined position due to the rotation of the transport drum 131 and deenergizer the motor M1 (S823). Subsequently, the controller 700 energizes the solenoid MG7 (S824) to rotate the blade 134, as indicated by an arrow in FIG. 7. Thereafter, the controller 700 reverses the main motor M1 (S825) to thereby rotate the transport drum 131 in the reverse direction REV. As a result, the slip B1 is moved along the transport path 138 to the blade 140 and then guided by the blade 140 to the transport path 155. When the sensor 19 senses the slip B1 on the transport path 155 (S826), the controller 700 turns off the main motor M1 on the elapse of a predetermined period of time $t_2$ to thereby stop the reverse rotation of the drum 131 (S827). In this condition, the leading edge of the slip B1 is positioned between the platen roller 145 and the print head 144 of the printing unit 610 (see FIG. 6A, arrow g).

Subsequently, the controller 700 energizes the solenoid MG4 to press the print head 144 against the platen roller 145 (S828). At the same time, the controller 700 turns on the motor M2 to start taking up the transfer paper 149. At this time, the controller 700 causes the print head 144 to print out data indentical in content with the magnetic data on the slip B1. Consequently, the slip B1 is provided with a format as a boarding ticket belonging to the airline B (S830). On completing the printing operation, the controller 700 determines whether or not the detection signal from the sensor 19 has dissappeared (S831). If the answer of the step S831 is positive, meaning that the slip B1 has moved away from the sensor 19, the controller 700 deenergizes the solenoid MG4 on the lapse of a predetermined period of time $t_3$ (S832). As a result, the print head 144 is moved away from the platen roller 145 to release the slip B1. Subsequently, the controller 700 rotates the drive roller 146 with the result that the slip B1 is transported by the drive roller 146 and driven roller 147 to a tray associated with the slot or ticket outlet 105 via the sensor 59.

When the sensor 59 stops sending a detection signal indicative of the presence of the slip B1 to the controller 700 (S833), the controller 700 determines that the slip B1 carrying all the necessary data thereon has been discharged vis the outlet 105 as a boarding ticket of the airline B.

If the detection output of the sensor 19 does not disappear as determined in the step S831, the controller 700 deenergizes the solenoid MG7 (S834). If the detection output of the sensor 59 does not disappear in a predetermined period of time as determined in the step S833, the controller 700 turns on the alarm lamp since it determines that a jam or similar error has occurred (S835).

Assume that the operator has manipulated the input unit 601 to enter a command for issuing a boarding ticket of the airline A. Then, the controller 700 scans the data storage unit 702 to determine which cassette stores the slips A belonging to the airline A. In the illustrative embodiment, the controller 700 selects the cassette 113 which stores such slips A. When the cassette sensor 3 of the sensor group 53 senses the lug 113*a* and sends the resultant output thereof to the controller 700, the controller 700 determines that the cassette 113 exists in the slip storing section 44. Subsequently, the controller 700 energizes the solenoid MG3 and rotates the pick-up roller 119 with the result that uppermost one A1 of the slips A is paid out from the cassette 113. As the slip A1 is fed out via the feed roller 124 and reverse roller 125, only the sensor 11 sends a detection signal to the controller 700, and then only the sensor 13 turns off. In response, the controller 700 sees that the slip A1 has been fully fed out to the transport path 128. Thereafter, the slip A1 follows the route previously described with respect to the slip B1. As a result, the slip A1 is emitted through the slot or ticket outlet 105 as a boarding ticket of the airline A.

Further, assume that the operator has entered a command for issuing a boarding ticket of the airline C on the input unit 601. Then, by scanning the data storage unit 702, the controller 700 locates the cassette 111 which is loaded with the slips C of the airline C. When the cassette sensor 1 of the sensor group 55 senses the lug 111*a* and sends the resultant output thereof to the controller 700, the controller 700 determines that the cassette 111 exists in the slip storing section 46. Subsequently, the controller 700 energizes the solenoid MG1 and rotates the pick-up roller 117 with the result that uppermost one C1 of the slips C is paid out from the cassette 111. As the slip C1 is fed out via the feed roller 120 and reverse roller 121, only the sensor 10 sends a detection signal to the controller 700, and then only the sensor 12 turns off. In response, the controller 700 sees that the slip C1 has been fully fed out to the transport path 126. Thereafter, the slip C1 follows the route previously described with respect to the slip B1. As a result, the slip C1 is through the slot or outlet 105 as a boarding ticket of the airline C.

It may occur that the expected number of boarding tickets of the airline A, for example, to be issued is far greater than those of the other airlines B and C and is too great to be accommodated in a single cassette. In such a case, the slips A are accommodated in a plurality of cassettes, e.g., the cassettes 113 and 112. Then, the operator manipulates the input unit 601 to enter data indicating that the slips A are stored in both of the cassettes 113 and 112, and the resultant slip discrimination data are written to the data storage unit 702. Also written to the data storage unit 702 is priority data indicative of the priority given to either one of the two cassettes 113 and 112, i.e., from which cassette 113 or 112 the slips A should be fed out first. For example, when data which gives priority to the cassette 113 is entered, the controller 700 selects both of the cassette 113 and 112 in response to an issue command and then gives priority to the cassette 113. Thereafter, the slips A are sequentially fed out from the cassette 113, printed with data, and then transported to the outlet 105.

When the end sensor 9 associated with the slip storing section 44 sends to the controller 700 a detection signal showing that the cassette 113 has run out of the slips A, the controller 700 selects the cassette 112 in place of the cassette 113. Therefore, in response to the following issue command meant for the airline A, the slips A will be sequentially fed out from the cassette 112 and processed in the same manner as the slips A from the cassette 113. Such a procedure allows the boarding tickets of the airline A to be sequentially issued without interruption, i.e., saves time otherwise wasted by the repetitive supply of slips to a single cassette.

Figure 10A:
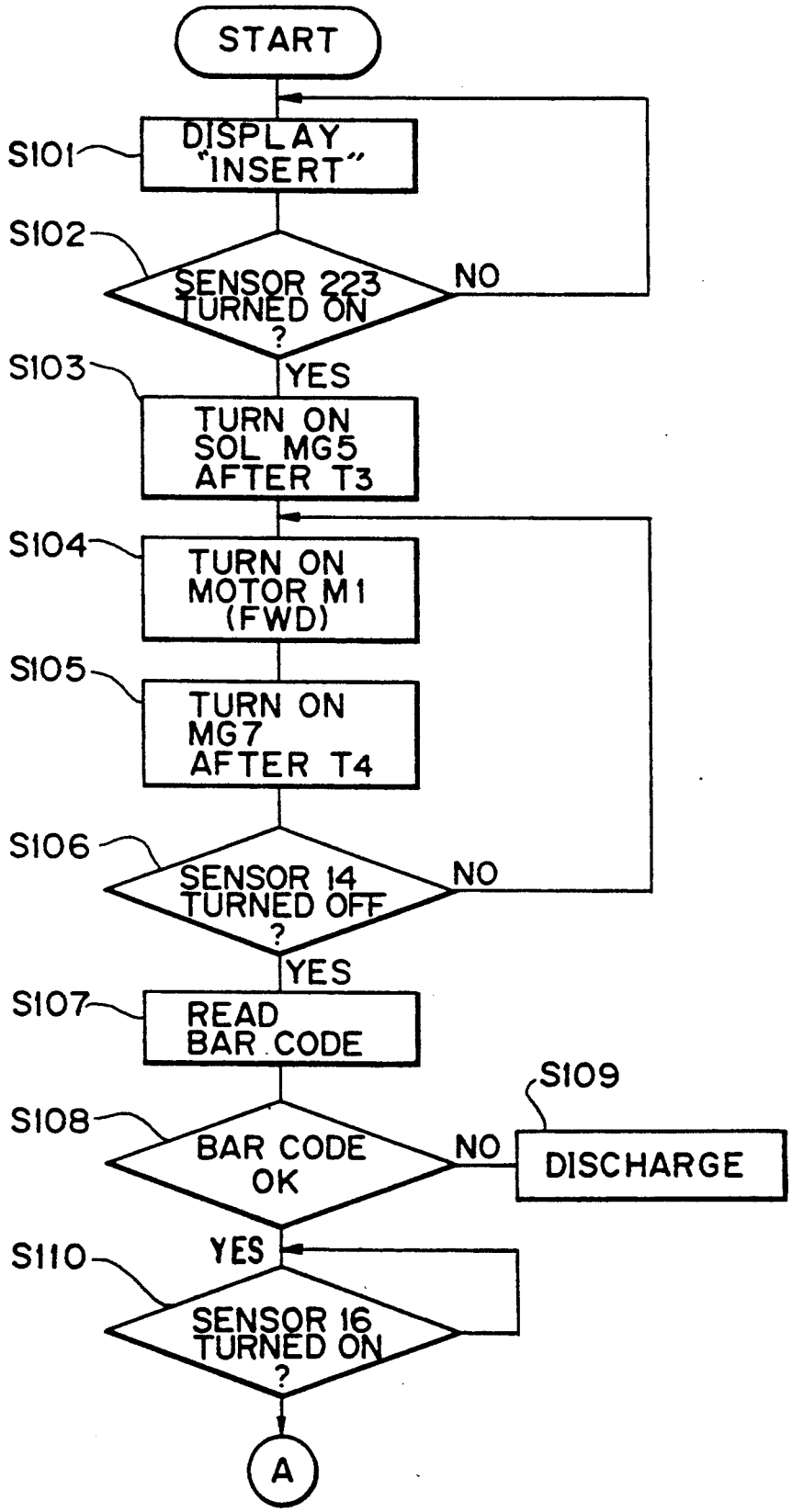
FIGS. 10A through 10C are flowcharts demonstrating the operation of the embodiment while invalidating a ticket previously issued to a customer.
Figure 10B:
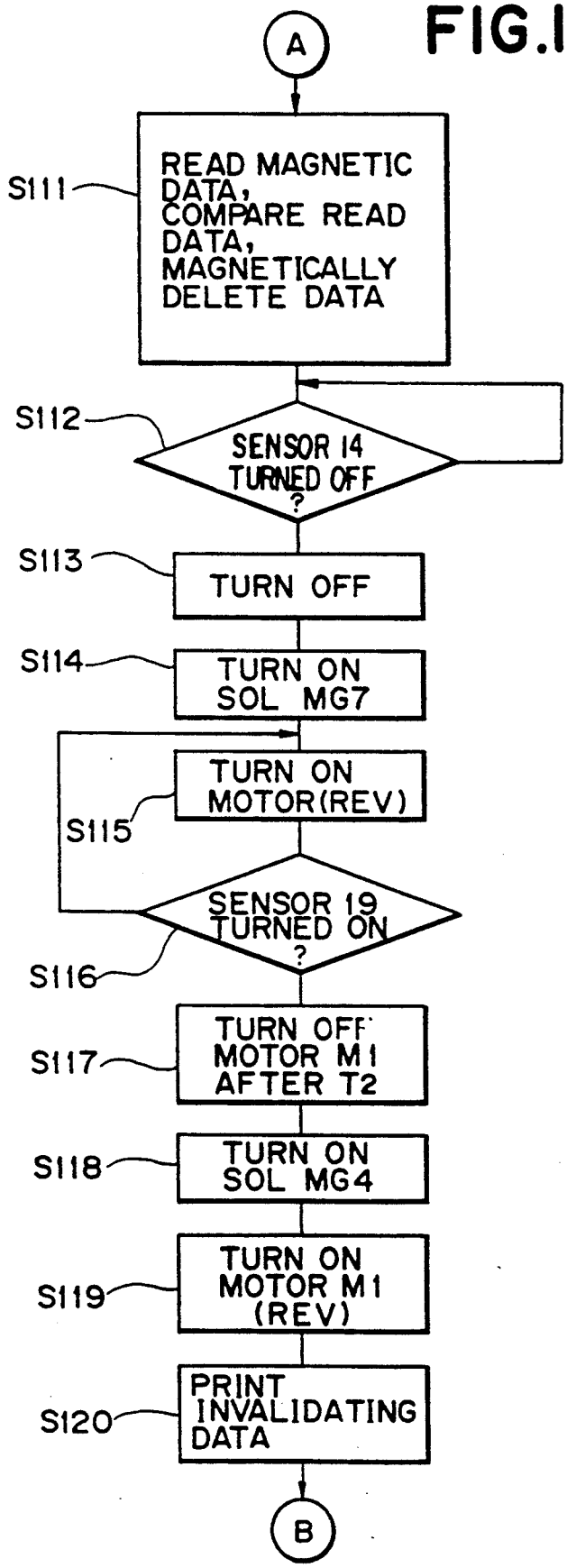
Figure 10C:
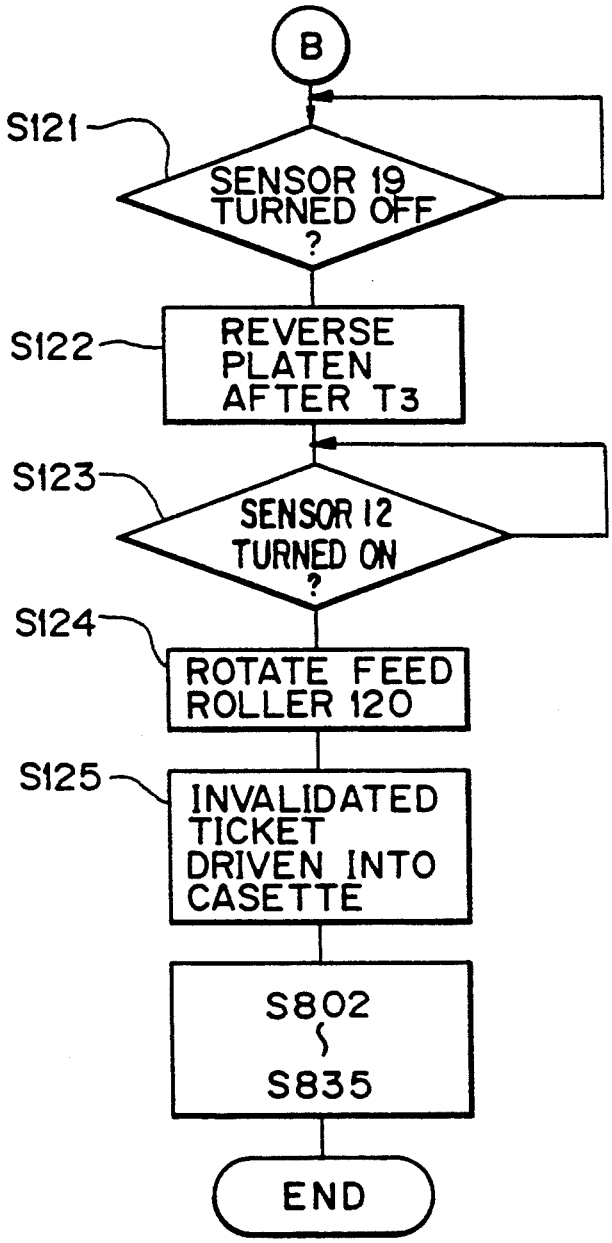

Referring to FIGS. 10A through 10C, how the illustrative embodiment invalidates or discards a boarding ticket previously issued to a customer will now be described. To begin with, the operator performs a predetermined operation for invalidation on the input unit 601. In response, the controller 700 displays on the display 103 a message such as "INSERT" to show the operator that the apparatus body 100 is ready to receive a boarding ticket 200, FIG. 3, to be invalidated (S101). Then, the operator inserts the boarding ticket 200 into the slot or inlet 106. When the sensor 223 senses the ticket 200 (S102), the controller 700 energizes the solenoid MG5 on the elapse of a predetermined period of time $t_3$ (S103). The solenoid MG5 urges the driven roller 143 against the drive roller 142 and opens the stop 141. As a result, the ticket 200 is driven to the transport path 139 by the drive roller 142 by way of the stop 141 (see FIG. 6B, arrow h).

Subsequently, the controller 700 drives the main motor M1 in the forward direction (S104) and, on the elapse of a predetermined period of time $t_4$, energizes the solenoid MG7 to rotate the blade 134 on the transport path 138 in the direction shown in FIG. 7 (S105). In this condition, the ticket 200 is transferred from the transport path 139 to the transport path 138 by way of the blade 134 and reaches the transport drum 131 which is rotating in the forward direction FWD. The timing sensor 14 associated with the transport drum 131 turns on as soon as it senses the ticket 200. After the timing sensor 14 has turned off (S106), the slip discriminating unit or bar code reader 135 reads the bar code of the ticket 200 (S107). If the bar code of the ticket 200 is not identical with the bar code representative of the ticket to be invalidated (S108), the ticket 200 is rejected and driven out of the apparatus body 100 (S109).

Figure 6B:
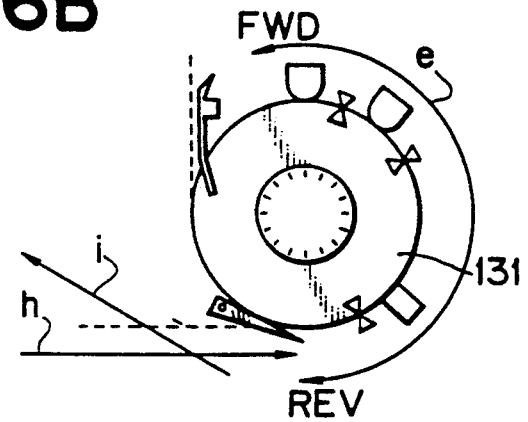
Figure 6C:
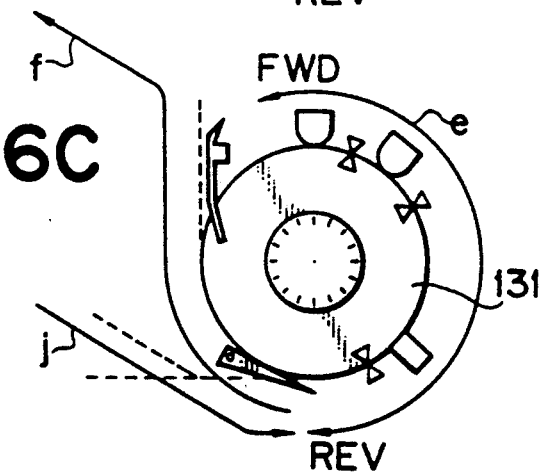

If the bar code read by the discriminating unit 135 is representative of the ticket to be invalidated as determined in the step S108, the ticket 200 is further transported by the transport drum 131 in the forward direction FWD, as indicated by the arrow e in FIG. 6B. When the timing sensor 16 senses the ticket 200 and sends the output thereof to the controller 700 (S110), the controller 700 causes the read head 137 to read magnetic data stored in the ticket 200 compares the read data, and then magnetically deletes it as the ticket 200 is carried past write head 136 on a second trip around transport drum 131 (S111). When the detection output of the timing sensor 14 disappears disappears on the first trip (step S106), the controller 700 also deenergizes the solenoid MG7 to return the blade 134 to the position shown in FIG. 3. Then, when the timing sensor 14 turns off on the second trip (S112), the controller 700 deenergizes the main motor M1 (S113) and then energizes the solenoid MG7 (S114). Consequently, the blade 134 is again rotated to the position where the transpot drum 131 communicates with the transport path 138. Thereafter, the controller 700 reverses the main motor M1 (S115) to thereby rotate the drum 131 and, therefore, the ticket 200 in the reverse direction REV. The ticket 200 enters the transport path 155 via the blade 134 which is in the open position (see FIG. 6B, arrow i). On sensing the ticket 200, the timing sensor 19 located on the transport path 155 sends a detection signal to the controller 700 (S116). Then, on the elapse of a predetermined period of time $t_2$, the controller 700 deenergizes the main motor M1 to prevent the ticket 200 from being further transported toward the rollers 146 and 147 (S117). The controller 700 energizes the solenoid MG4 of the printing section 610 (S118) to press the print head 144 against the platen roller 145 with the ticket 200 between them. The print head 144 is now ready to print out data on the ticket 200. Subsequently, the controller 700 further rotates the main motor M1 in the reverse direction (S119), thereby driving the ticket 200 toward the rollers 146 and 147. At this time, the print head 144 prints out invalidating data on the ticket 200 in response to the data fed thereto from the input unit 601 (S120).

When the ticket 200 on the transport path 155 is further driven until it moves away from the timing sensor 19, the timing sensor 19 turns off (S121). Then, on the elapse of the predetermined period of time $t_3$ for the printing operation to be completed, the controller 700 reverses the platen 145 to return the invalidated ticket 200 to the transport drum 131 (S122) (see FIG. 6C, arrows j and e). Thereafter, the controller 700 rotates the transport drum 131 in the reverse direction REV with the result that the invalidated ticket 200 is routed through the blade 133, transport path 150 and blade 129 to the transport path 126 (see FIG. 6C, arrows e and f).

When the sensor 12 senses the invalidated ticket 200 on the transport path 126 (S123), the controller 700 rotates the feed roller 120 to drive the ticket 200 toward the cassette 111 (S124). In this case, the cassette 111 plays the role of a receptacle for accommodating such invalidated tickets. When the ticket 200 is about to reach the cassette 111, the sensor 10 begins producing a detection output. In response, the controller 700 determines that the ticket 200 is being driven into the cassette 111 (S125). When the detection signal of the sensor 10 disappears, the controller 700 determines that the invalidated ticket 200 has been fully received in the cassette 111. Afterwards, the controller 700 returns to the step S802, FIG. 9A, to wait for an issue command meant for any one of the slips in the cassettes 113 and 112.

Figure 11A:
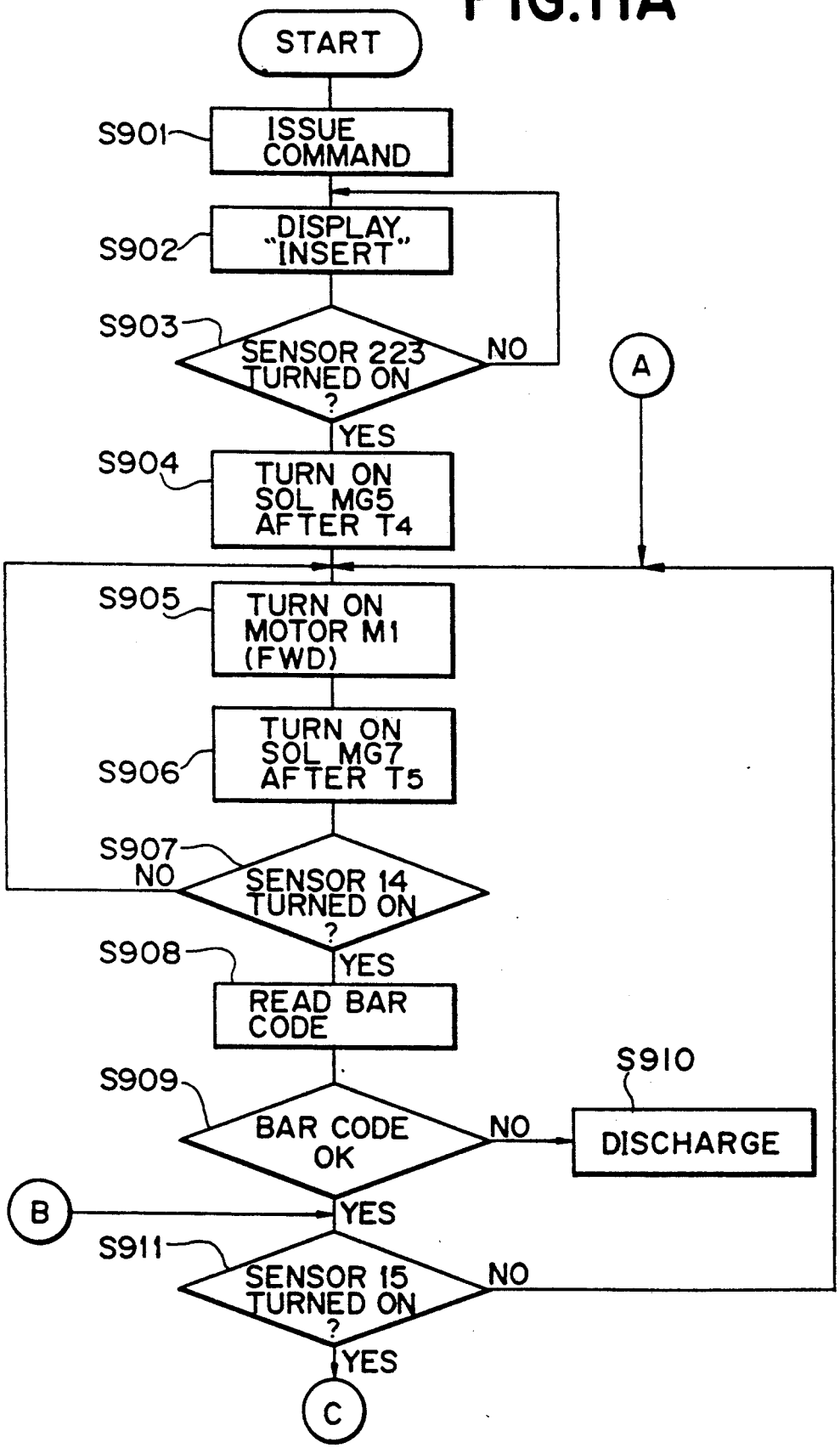
FIGS. 11A and 11B are flowcharts showing the operation of the embodiment while handling an extra or further kind of slip which is not expected to be accommodated in the cassettes of the embodiment.
Figure 11B:
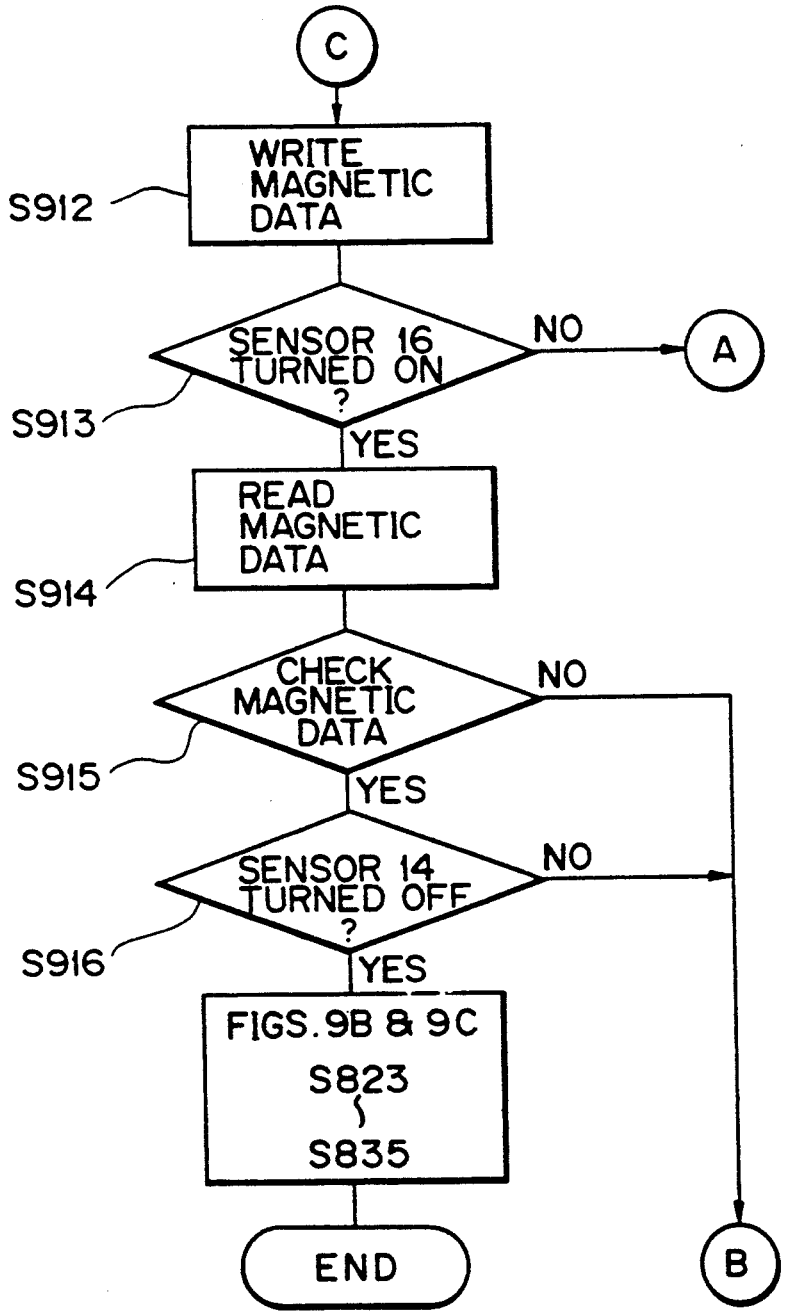

The illustrative embodiment is capable of dealing even with a slip or ticket medium which is not expected to be accommodated in any of the cassettes 111–113, e.g., a slip belonging to an unexpected airline, as will be described with reference to FIGS. 11A and 11B. Specifically, on the entry of an issue command (S901), the controller 700 displays a message such as "INSERT" on the display 103 of the apparatus body 100 for urging the operator to insert such an extra or further kind of slip 201, FIG. 3, belonging to a particular airline into the slot or inlet 106 (S902). When the sensor 223 senses the slip 201 and sends a detection output to the controller 700 (FIG. 903), the controller 700 energizes the solenoid MG5 on the elapse of a predetermined period of time $t_4$ to thereby open the stop 141 (S904).

The controller 700 drives the main motor M1 in the forward direction (S905) and, on the elapse of a predetermined period of time $t_5$, energizes the solenoid MG7 to rotate the blade 134 to the position shown in FIG. 7 (S906). As a result, the blade 134 unblocks the transport path 138 terminating at the transport drum 131. The slip 201 is sequentially transported along the paths 139 and 138 is further transported by the transport drum 131 in the forward direction FWD. When the timing sensor 14 senses the slip 201 (S907), the controller 700 causes the slip discriminating unit 135 to read the bar code of the slip 201 in response to the output of the timing sensor 14 (S908). At this instant, the slip discriminating unit 135 reads the bard code while the slip 201 is in transport. When the trailing edge of the slip 201 moves away from the timing sensor 14, the timing sensor 14 turns off with the result that the controller 700 deenergizes the solenoid MG7. This returns the blade 134 from the position shown in FIG. 7 to the position shown in FIG. 3. If the bar code read by the discriminating unit 135 is not identical with any one of predetermined bar codes which the apparatus can deal with (S909), the controller 700 determines that the apparatus cannot handle the slip 201 and then simply discharges it (S910).

If the bar code of the slip 201 is identical with any one of the predetermined bar codes as determined in the step S909, meaning that the apparatus can handle the slip 201, the controller 700 rotates the transport drum 131 to further transport the slip 201 in the direction FWD. As soon as the timing sensor 15 turns on by sensing the slip 201 (S911), the write head 136 magnetically writes predetermined data in the slip 201 in the previously stated manner (S912). When the timing sensor 16 turns on (S913), the read head 137 magnetically reads the data out of the slip 201 (S914). This is followed by a step S915 for checking the magnetic data read out of the slip 201. On the turn-off of the timing sensor 14 (S916), the controller 700 executes the sequence of steps S823–S835 shown in FIG. 9B. As a result, the slip 201 is issued as a boarding ticket of the extra airline.

In the apparatus body 100 shown in FIG. 3, the sensor groups 53, 54 and 55, pick-up rollers 119-118 and 117, solenoids MG3, MG2 and MG1, feed rollers 124, 122 and 120, reverse rollers 125, 123 and 121, near-end sensors 8, 6 and 4, and end sensors 9, 7 and 5 may be affixed to the cassette mounts 50, 51 and 52, respectively. Then, each of the cassette mounts 50, 51 and 52 will have a unit configuration and can be removably mounted on the apparatus.

In summary, in the illustrative embodiment, the slip discriminating unit 135, magnetic write head 136 and magnetic read head 137 are arranged around the transport drum 131. This allows the discriminating unit 135 to determine the kind of a slip and the heads 136 and 137 to write and read magnetic data while causing the transport drum 131 to transport the slip along the transport drum. This, coupled with the fact that the printing section 610 can be disposed in close proximity to the drum 131, reduces the overall height of the apparatus body 100 and thereby miniaturizes the body 100 even when a plurality of slip storing sections 44–46 are disposed one above another. Such an apparatus body 100 remains stable when put on a desk or similar support and occupies a minimum of space.

Since the printing section 610 is positioned in the lower portion of the apparatus body 100, the slots 105 and 106 for the egress and ingress of slips can be provided on the front end of the body 100. This facilitates the operations for taking out and inserting tickets into the apparatus body 100 and thereby enhances operability.

In the illustrative embodiment, the transport drum 131 defines a circumferential transport path. This eliminates the need for feed rollers otherwise located to face the write head 136 and read had 137.

While the embodiment is implemented as a ticket issuing apparatus having a plurality of slip storing sections 44–46, it may, of course, be implemented as an apparatus having a single slip storing section. In such a case, since slips of only one kind are fed out from the slip storing section, the slip discriminating unit 135 does not have to be positioned in the vicinity of the transport drum 131 and may instead be situated on the transport path 139 contiguous with the inlet 106.

If desired, the transport drum 131 may be replaced with an annular transport guide and feed rollers arranged around the transport guide. Then, a magnetic write head and a magnetic read head will also be arranged around the transport guide. The gist is that a slip or ticket medium be transported along a circumferential transport path.

While the present invention has been described with reference to the particular illustrative embodiment, it is not to be restricted to the embodiment but only by the appended claims. It is to be appreciated that those skilled in the art can change or modify the embodiment without departing from the scope and spirit of the present invention.

What is claimed is:

1. A ticket issuing apparatus, comprising:

slip storing means for storing slips which can be printed on and which can be written on magnetically, said slip storing means having a plurality of storage sections;

transport means for transporting a slip fed from said slip storing means along transport paths, said transport means including a transport drum which is rotatable in forward and reverse directions;

magnetic data writing means for writing magnetic data on said slip fed from said slip storing means, said magnetic data writing means being located at the circumference of said transport drum;

magnetic data reading means for reading magnetic data written on said slip fed from said slip storing means so that the written magnetic data can be checked, said magnetic data reading means being located at the circumference of said transport drum;

printing means, located along one of said transport paths, for printing data on said slip fed from said slip storing means, the printed data corresponding to the written magnetic data; and discharge means for discharging the printed slip from said apparatus.

2. An apparatus in accordance with claim 1, wherein said printing means is located in the vicinity of said transport drum.

3. An apparatus in accordance with claim 2, wherein said printing means is located in a horizontal direction from said transport drum.

4. An apparatus in accordance with claim 1, wherein said magnetic data writing means and said magnetic data reading means are arranged at said transport drum so as to be adjacent each other.

5. An apparatus in accordance with claim 1, further comprising:

slip discriminating unit means, located at the circumference of said transport drum, for discriminating the kind of slip fed thereto; and data storage means for storing discrimination data for slips stored in said storing means.

6. An apparatus in accordance with claim 5, further comprising:

slip feeding means for feeding said slips stored in said slip storing means to said transport paths; and control means for selecting, on receiving a command entered by an operator for indicating that a particular kind of slip stored in said slip storing means is to be issued, the particular kind of slip on the basis of said discrimination data, and for driving said slip feeding means to feed the particular kind of slip.

7. An apparatus in accordance with claim 6, further comprising:

ticket receiving means for receiving a previously-issued ticket from outside of said apparatus; and invalidated ticket collecting means for invalidating the previously-issued ticket and collecting the invalidated ticket in a particular one of said plurality of slip storing sections that has been selected as not storing slips that are to be issued.

8. An apparatus in accordance with claim 1, further comprising:

data storage means for storing priority data entered by an operator to indicate a feeding priority order for slips stored in said slip storing means;

slip feeding means for feeding slips stored in said slip storing means to said transport paths; and control means for driving said slip feeding means so that said slip fed from said slip storing means is fed from a particular storage section of said slip storing means in accordance with said priority data.

9. An apparatus in accordance with claim 1, further comprising a sensing disk that is operatively connected to said transport drum, and a photocoupler which cooperates with the sensing disk to monitor the forward and reverse rotations of said transport drum.

10. A ticket issuing apparatus, comprising:

slip storing means for storing slips which can be printed on and which can be written on magnetically, said slip storing means having a plurality of storage sections;

a transport drum;

a magnetic write head at the circumference of the transport drum;

a magnetic read head at the circumference of the transport drum;

a printer;

means for moving a slip from the slip storing means to the transport drum;

means for rotating the transport drum in a forward direction to carry the slip to the magnetic heads and for then rotating the transport drum in a reverse direction to carry the slip toward the printer.

11. A ticket issuing apparatus according to claim 10, wherein the printer comprises a print head which is disposed lower than at least one of the magnetic heads.

12. A ticket issuing apparatus according to claim 11, wherein the printer is mounted beside the transport drum and the print head is disposed lower than both of the magnetic heads.

13. A ticket issuing apparatus according to claim 10, wherein ticket type information is provided on the tickets, and further comprising discriminating means, at the circumference of the transport drum, for reading the ticket type information.

14. A ticket issuing apparatus according to claim 10, wherein different kinds of slips are stored in different storage sections, and wherein the means for moving a slip from the slip storing means to the transport drum comprises means, responsive to a command entered by an operator to designate a particular kind of slip, for withdrawing the slip from the storage section that stores the particular kind of slip.

15. A ticket issuing apparatus according to claim 10, wherein the storage sections of the slip storing means include a first storage section which stores a predetermined kind of slip and a second storage section which also stores the predetermined kind of slip, and wherein the means for moving the slip from the storing means to the transport drum comprises means, responsive to a command entered by an operator to designate the predetermined kind of slip, for withdrawing the slip from the first storage section unless it is empty and for withdrawing the slip from the second storage section if the first storage section is empty.

16. A ticket issuing apparatus according to claim 10, wherein one of the storage sections is a collection storage location which does not store slips that are to be issued, and further comprising means for moving a previously-issued ticket to the transport drum and for moving the previously-issued ticket to the collection storage location after the drum has rotated in the forward and reverse directions.

17. A ticket issuing apparatus in accordance with claim 10, further comprising a plurality of pivotally mounted blade means for directing the slip during movement through the apparatus.

18. A ticket issuing apparatus in accordance with claim 10, further comprising a pivotally mounted blade adjacent the transport drum, and a solenoid to pivot the blade between a portion tangent to the circumference of the drum and a position transverse to the circumference.

19. A ticket issuing apparatus in accordance with claim 10, further comprising means for optically detecting when each storage section is empty.

20. A ticket issuing apparatus in accordance with claim 10, further comprising means for detecting when each storage section is nearly empty.

* * * * *